US009142174B2

(12) United States Patent
Pyun et al.

(10) Patent No.: US 9,142,174 B2
(45) Date of Patent: Sep. 22, 2015

(54) METHOD OF DRIVING A DISPLAY PANEL AND A DISPLAY APPARATUS FOR PERFORMING THE METHOD

(71) Applicant: SAMSUNG DISPLAY CO., LTD, Yongin, Gyeonggi-do (KR)

(72) Inventors: Ki-Hyun Pyun, Goyang-si (KR); Ju-Hyun Kim, Asan-si (KR); Yong-Jae Lee, Seoul (KR)

(73) Assignee: Samsung Display Co., Ltd., Yongin, Gyeonggi-do (KR)

( * ) Notice: Subject to any disclaimer, the term of this patent is extended or adjusted under 35 U.S.C. 154(b) by 81 days.

(21) Appl. No.: 14/027,952

(22) Filed: Sep. 16, 2013

(65) Prior Publication Data

US 2014/0292627 A1 Oct. 2, 2014

(30) Foreign Application Priority Data

Apr. 2, 2013 (KR) ..... 10-2013-0035789

(51) Int. Cl.
*G09G 3/36* (2006.01)

(52) U.S. Cl.
CPC ..... *G09G 3/3614* (2013.01); *G09G 3/3648* (2013.01); *G09G 2320/00* (2013.01); *G09G 2320/0252* (2013.01)

(58) Field of Classification Search
CPC . G09G 3/3611; G09G 3/3614; G09G 3/3648; G09G 3/3677; G09G 3/3688; G09G 2310/02; G09G 2310/0254; G09G 2310/0256; G09G 2310/0232; G09G 2310/061; G09G 2310/062; G09G 2310/063; G09G 2320/00; G09G 2320/02; G09G 2320/0252
USPC ..... 345/94, 96, 98, 99, 100, 214
See application file for complete search history.

(56) References Cited

U.S. PATENT DOCUMENTS

| | | | | |
|---|---|---|---|---|
| 5,867,141 | A * | 2/1999 | Asada et al. | 345/100 |
| 8,248,344 | B2 * | 8/2012 | Song | 345/96 |
| 2007/0046614 | A1 * | 3/2007 | Chien | 345/100 |
| 2007/0296661 | A1 * | 12/2007 | Ishiguchi | 345/87 |
| 2009/0219237 | A1 | 9/2009 | Yamazaki | |
| 2010/0118013 | A1 * | 5/2010 | Kitayama et al. | 345/211 |
| 2012/0062543 | A1 | 3/2012 | Suyama et al. | |
| 2012/0133630 | A1 | 5/2012 | Oh et al. | |

FOREIGN PATENT DOCUMENTS

| | | |
|---|---|---|
| JP | 2006251038 | 9/2006 |
| JP | 2009271267 | 11/2009 |
| JP | 2010197485 | 9/2010 |
| KR | 1020040043214 | 5/2004 |
| KR | 0831284 | 5/2008 |
| KR | 1217511 | 12/2012 |

* cited by examiner

*Primary Examiner* — Tom Sheng
(74) *Attorney, Agent, or Firm* — F. Chau & Associates, LLC

(57) ABSTRACT

A method of driving a display panel includes providing at least one gate line among a plurality of gate lines disposed in the display panel with a gate signal of a gate-on level during a vertical blanking period of a frame period and providing a data line disposed in the display panel with data voltages of a first polarity and a second polarity opposite to the first polarity during the vertical blanking period.

16 Claims, 4 Drawing Sheets

METHOD OF DRIVING A DISPLAY PANEL AND A DISPLAY APPARATUS FOR PERFORMING THE METHOD

CROSS-REFERENCE TO RELATED APPLICATION

This application claims priority under 35 U.S.C. §119 to Korean Patent Application No. 10-2013-0035789, filed on Apr. 2, 2013, the disclosure of which is incorporated by reference herein in its entirety.

TECHNICAL FIELD

The present invention relates to a method of driving a display panel and a display apparatus for performing the method of driving the display panel.

DISCUSSION OF THE RELATED ART

Generally, a liquid crystal display ("LCD") apparatus has a relatively thin thickness, light weight and low power consumption, and thus, the LCD apparatus is used to display images in monitors, laptop computers, cellular phones and so on. The LCD apparatus includes an LCD panel for displaying images by using light transmittance of liquid crystal, a backlight assembly for providing light to the LCD panel and a driving circuit for driving the LCD panel.

The LCD panel includes an array substrate, an opposing substrate and an LC layer. The array substrate includes a gate line, a data line, a thin film transistor and a pixel electrode. The opposing substrate is disposed opposite to the array substrate and includes a common electrode. The LC layer is disposed between the array substrate and the opposing substrate. The driving circuit includes a direct current (DC)-to-DC converting part which generates a driving voltage to drive the LCD panel. The driving voltage includes a gate driving voltage applied to a gate driving part and a data driving voltage applied to a data driving part.

The LCD panel is driven by a frame period which includes an active period and a vertical blanking period. During the active period, the LCD panel receives a driving signal which includes a gate signal and a data signal. During the vertical blanking period, the LCD panel does not receive the driving signal.

Therefore, during the vertical blanking period, an output end portion of the DC-to-DC converting part outputs the driving signal so that a load of the output end portion may be relatively increased. However, during the active period, the output end portion of the DC-to-DC converting part does not output the driving signal so that the load of the output end portion may be relatively decreased. Particularly, during a period in which the active period of a frame is started, the load of the output end portion is decreased and an output current of the output end portion is increased. Then, during a period in which the active period of a next frame period is started, the load of the output end portion is increased and an output current of the output end portion is decreased. Therefore, a ripple occurs due to voltage regulation of the output end portion.

The ripple can affect charging and discharging of a capacitor connected to the output end portion of the DC-to-DC converting part, because the ripple can cause a metal plate in the capacitor to vibrate and thus generate an audible noise. In addition, a driving reliability of the LCD panel may be decreased by the voltage regulation of the output end portion.

SUMMARY

Exemplary embodiments of the present invention provide a method of driving a display panel, the method being capable of improving a driving reliability of the display panel.

Exemplary embodiments of the present invention provide a display apparatus for performing the method of driving the display panel.

According to an exemplary embodiment of the invention, there is provided a method of driving a display panel that includes providing at least one gate line among a plurality of gate lines disposed in the display panel with a gate signal of a gate-on level during a vertical blanking period of a frame period and providing a data line disposed in the display panel with data voltages of a first polarity and a second polarity opposite to the first polarity during the vertical blanking period.

In an exemplary embodiment of the present invention, the gate signal of the gate-on level may be applied to a last gate line among the plurality of gate lines during the vertical blanking period.

In an exemplary embodiment of the present invention, the gate signal of the gate-on level applied to the last gate line may have a pulse width greater than a pulse width of a gate signal previously applied to another gate line.

In an exemplary embodiment of the present invention, the data voltages of the first and second polarities may correspond to a black gray-scale.

In an exemplary embodiment of the present invention, the data voltages of the first and second polarities may correspond to a gray-scale of a pixel connected to the last gate line.

In an exemplary embodiment of the present invention, the method may further include generating a polarity control signal for controlling the polarity of the data voltages, wherein the polarity control signal swings between a high level and a low level during the vertical blanking period.

According to an exemplary embodiment of the invention, there is provided a display apparatus that includes a display panel comprising a plurality of gate lines and a plurality of data lines, a gate driving part configured to provide at least one gate line among the plurality of gate lines with a gate signal of a gate-on level during a vertical blanking period of a frame period, and a data driving part configured to provide a data line disposed in the display panel with data voltages of a first polarity and a second polarity opposite to the first polarity during the vertical blanking period.

In an exemplary embodiment of the present invention, the gate driving part may provide a last gate line among the plurality of gate lines with the gate signal of the gate-on level during the vertical blanking period.

In an exemplary embodiment of the present invention, the gate signal of the gate-on level applied to the last gate line may have a pulse width greater than a pulse width of a gate signal previously applied to another gate line.

In an exemplary embodiment of the present invention, the display panel may include a display area configured to display an image and a blocking area surrounding the display area and configured to block light, and a pixel connected to the last gate line may be disposed in the blocking area.

In an exemplary embodiment of the present invention, the data voltages of the first and second polarities may correspond to a black gray-scale.

In an exemplary embodiment of the present invention, the display panel may include a display area configured to display an image and a blocking area surrounding the display area and configured to block light, and a pixel connected to the last gate line may be disposed in the display area.

In an exemplary embodiment of the present invention, the data voltages of the first and second polarities may correspond to a gray-scale of a pixel connected to the last gate line.

In an exemplary embodiment of the present invention, the display apparatus may further include a timing control part configured to generate a polarity control signal for controlling the polarity of the data voltages, wherein the polarity control signal may swing between a high level and a low level during the vertical blanking period.

In an exemplary embodiment of the present invention, the polarity control signal may swing between the high level and the low level during an active period of the frame period.

In an exemplary embodiment of the present invention, the polarity control signal may be maintained at the high level or the low level during the active period of the frame period.

According to an exemplary embodiment of the present invention, there is provided a method of driving a display panel that includes activating a gate line of the display panel during a vertical blanking period; and applying a data voltage to a data line of the display panel during the vertical blanking period, wherein the data voltage is repeatedly alternated between different voltage levels during the vertical blanking period.

The gate line may be a dummy line of the display panel.

The gate line may be a last horizontal gate line of the display panel.

The different voltage levels may correspond to black voltages or white voltages.

BRIEF DESCRIPTION OF THE DRAWINGS

The above and other features of the present invention will become more apparent by describing in detail exemplary embodiments thereof with reference to the accompanying drawings, in which.

DETAILED DESCRIPTION OF THE EMBODIMENTS

Hereinafter, exemplary embodiments of the present invention will be explained in detail with reference to the accompanying drawings.

Figure 1:
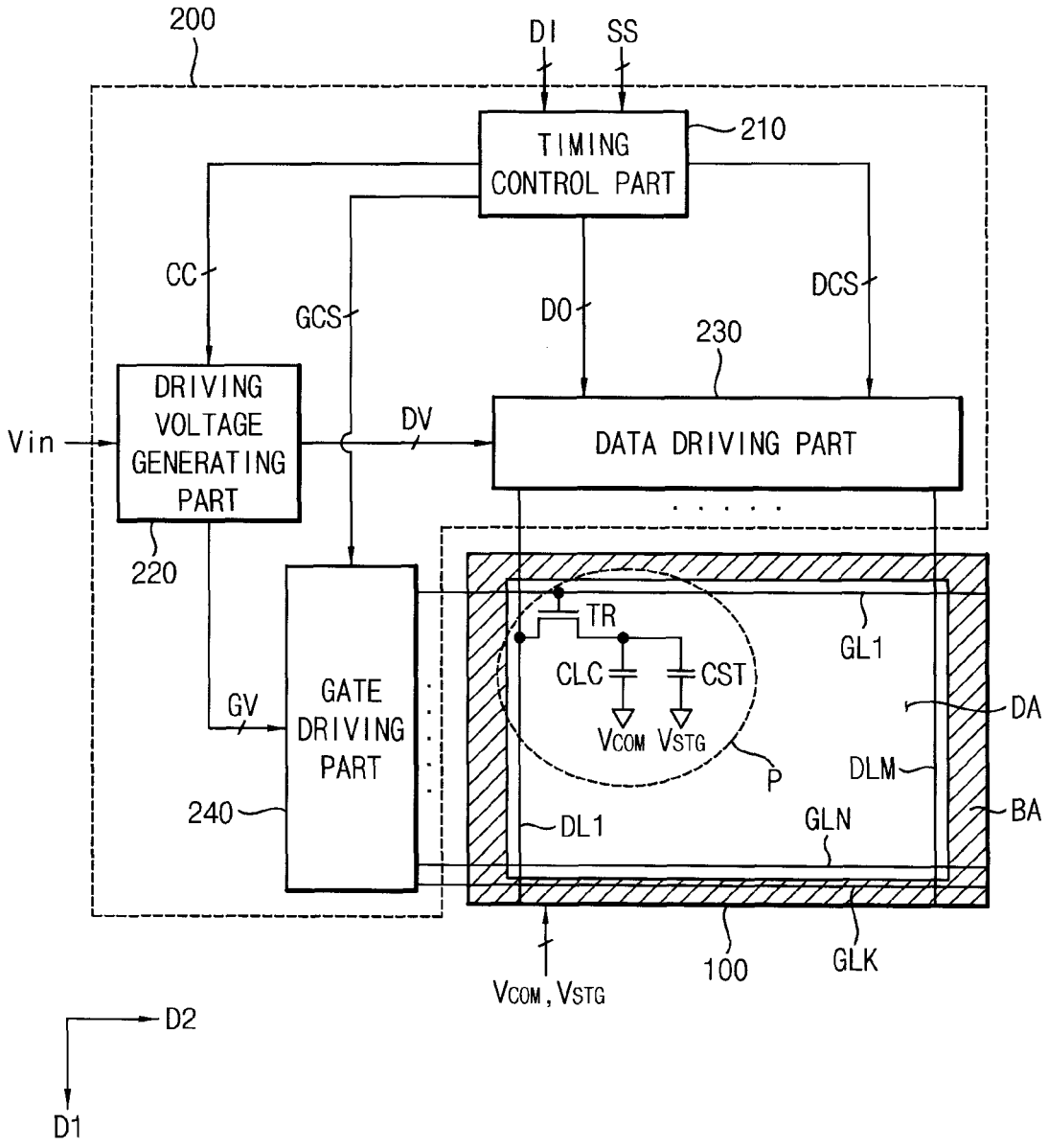
FIG. 1 is a block diagram illustrating a display apparatus according to an exemplary embodiment of the present invention.

FIG. 1 is a block diagram illustrating a display apparatus according to an exemplary embodiment of the present invention.

Referring to FIG. 1, the display apparatus may include a display panel 100 and a panel driving part 200 for driving the display panel 100.

The display panel 100 may include a plurality of pixels P, M data lines DL1, . . . , DLM and K gate lines GL1, . . . , GLK (wherein, M and K are natural numbers).

The pixels P are disposed in a display area DA of the display panel 100 and display an image. Each of the pixels P may include a switching element TR, a liquid crystal ("LC") capacitor CLC and a storage capacitor CST. The switching element TR is connected to the data line DL1 and the gate line GL1. The LC capacitor CLC is connected to the switching element TR. The storage capacitor CST is connected to the LC capacitor CLC. The storage capacitor CST includes an end portion for receiving a common voltage VSTG and the LC capacitor CLC includes an end portion for receiving a reference voltage VCOM.

The data lines DL1, . . . , DLM are extended in a first direction D1 and arranged in a second direction D2 crossing the first direction D1. The gate lines GL1, . . . , GLK are extended in the second direction D2 and arranged in the first direction D1.

The first to N-th gate lines GL1, . . . , GLN are electrically connected to the pixels P in the display area DA. A last gate line, in other words, a K-th gate line GLK is disposed in a blocking area BA surrounding the display area DA. The pixels P connected to the K-th gate line GLK are disposed in the blocking area BA. The K-th gate line GLK is a dummy line which may be irrelevant to the image displayed in the display area DA.

The panel driving part 200 may include a timing control part 210, a driving voltage generating part 220, a data driving part 230 and a gate driving part 240.

The timing control part 210 generates a timing control signal using vertical and horizontal synchronization signals SS. The timing control signal may include a control signal CC, a data control signal DCS and a gate control signal GCS. The control signal CC controls the driving voltage generating part 220, the data control signal DCS controls the data driving part 230 and the gate control signal GCS controls the gate driving part 240. The data control signal DCS may include a data enable signal DE, a polarity control signal POL, a load signal TP, etc. The gate control signal GCS may include a vertical starting signal STV, a clock signal CK, an inversion clock signal CKB, etc.

The polarity control signal POL includes an inversion signal and a swing signal. The inversion signal is generated during an active period of a frame period and has a signal type corresponding to an inversion mode. The swing signal is generated during a vertical blanking period of the frame period and has a signal type repetitively swinging between a high level and a low level. For example, when the inversion mode is a column inversion mode, the inversion signal of the polarity control signal POL has a direct current signal maintaining the high level or the low level during the active period. In addition, when the inversion mode is a dot inversion mode, the inversion signal of the polarity control signal POL has the swing signal repeating the high level and the low level every n horizontal period nH (herein, n is a natural number and H is a horizontal period) during the active period.

According to an exemplary embodiment of the present invention, the polarity control signal POL during the vertical blanking period has the swing signal which repeats the high level and the low level by a preset period. The preset period of the swing signal may be preset based on electric power consumption and voltage regulation of a driving voltage, for example, an analog supply voltage AVDD, output from the driving voltage generating part 220.

In addition, the timing control part 210 receives color data DI such as red, green, blue and so on, and corrects the color data DI using various compensation algorithms to generate corrected color data DO. The compensation algorithms may include a compensation algorithm for compensating the color white and a compensation algorithm for improving a response time of the LC.

The driving voltage generating part 220 generates a driving voltage using an external voltage Vin to drive the display panel 100. For example, the driving voltage may include a data driving voltage DV, a gate driving voltage GV, the common voltage VSTG, the reference voltage VCOM and so on. The data driving voltage DV is applied to the data driving part 230, the gate driving voltage GV is applied to the gate driving part 240 and the common voltage VSTG and the reference voltage VCOM are applied to the display panel 100. The common voltage VSTG may be the same as the reference voltage VCOM. The data driving voltage DV includes the analog supply voltage AVDD for generating a data voltage and a digital supply voltage DVDD for driving the data driving part 230. The gate driving voltage GV includes a gate-on voltage VON, a gate-off voltage VOFF and a gate source voltage VSS. The gate-on voltage VON and the gate-off voltage VOFF may be used to generate a gate signal and the gate source voltage VSS may be used to drive the gate driving part 240.

The data driving part 230 converts the corrected color data DO into the data voltage using the analog supply voltage AVDD. The data driving part 230 controls a polarity of the data voltage to a first polarity (+) or a second polarity (−) with respect to the reference voltage VCOM in response to the polarity control signal POL. The data driving part 230 outputs the data voltage to the data line DL1 of the display panel 100 in response to the load signal TP. Therefore, the data driving part 230 outputs the data voltage corresponding to a frame image during the active period of a frame period and the data voltage corresponding to a black gray-scale during the vertical blanking period of the frame period, in response to the data enable signal DE.

The gate driving part 240 generates a plurality of gate signals using the gate driving voltage GV and sequentially outputs the gate signals to the gate lines GL1, . . . , GLK.

According to an exemplary embodiment of the present invention, the gate driving part 240 sequentially provides first gate signals to the first to N-th gate lines GL1, . . . , GLN during the active period. Each of the first gate signals has a first pulse which has a gate-on level ON and a first pulse width is the same as a horizontal period (1H) or more than the horizontal period (1H) for pre-charging. The gate driving part 240 provides the K-th gate line GLK with a second gate signal during the vertical blanking period. The second gate signal has a second pulse which has a gate-on level ON and a second pulse width more than the first pulse width.

According to an exemplary embodiment of the present invention, the display panel 100 is driven during the active period and the display panel 100 is driven during the vertical blanking period. During the vertical blanking period, the K-th gate line GLK of the display panel 100 is driven so that pixels P in a last horizontal line connected to the K-th gate line GLK are driven. The pixels P in the last horizontal line connected to the K-th gate line GLK are disposed in the blocking area BA, and thus, a black image displayed on the last horizontal line is not seen by an observer's eyes.

Therefore, during the vertical blanking period, the load of the output end portion of the driving voltage generating part 220 may be prevented from being decreased so that the output current of the output end portion may be prevented from being increased. Thus, the voltage regulation of the output end portion may be decreased so that the driving reliability of the driving voltage generating part 220 may be improved. In addition, an audible noise caused by the voltage regulation may be removed.

Figure 2:
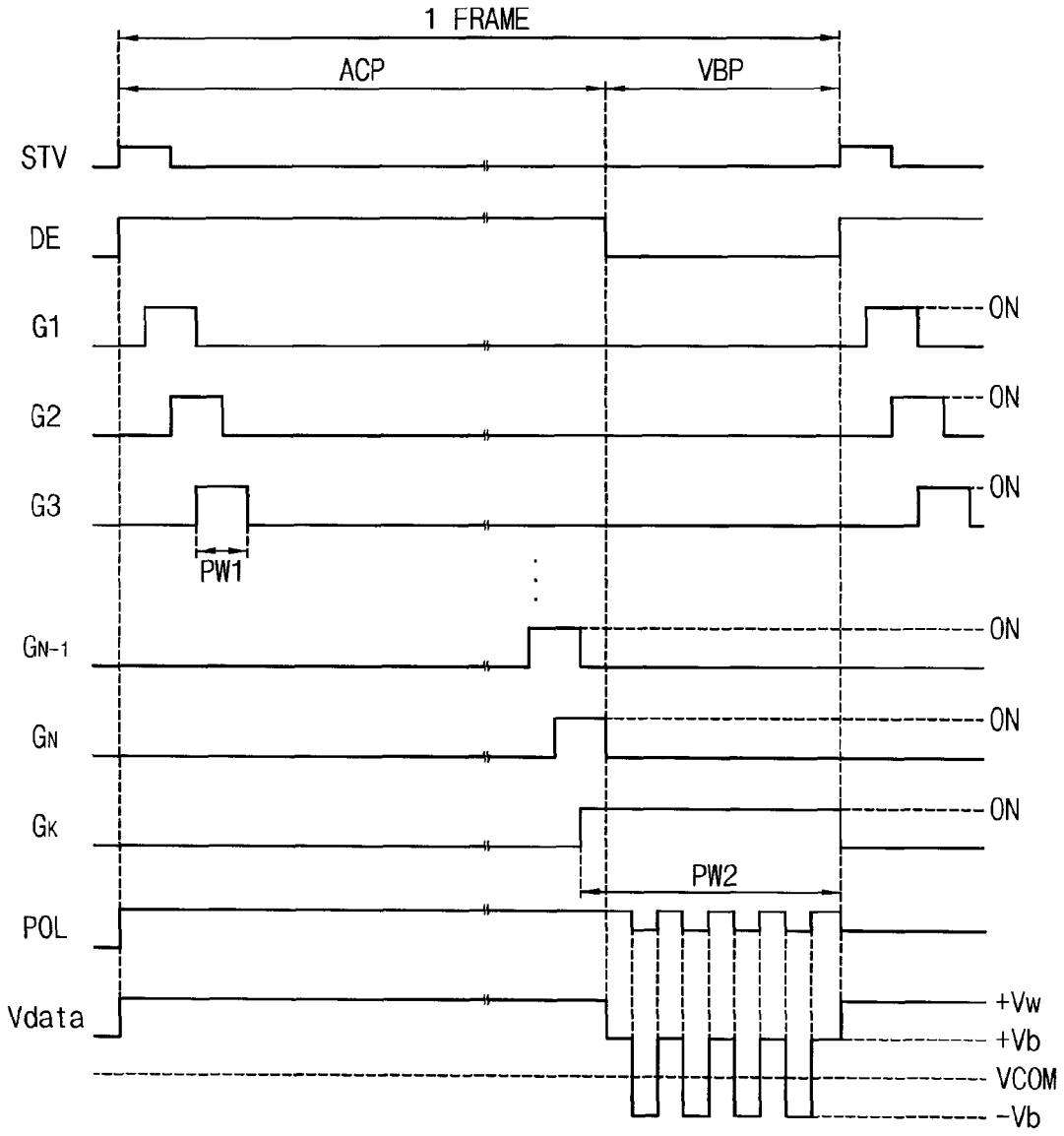
FIG. 2 is a waveform diagram illustrating a method of driving a display panel as shown in FIG. 1, according to an exemplary embodiment of the present invention.
Figure 3:
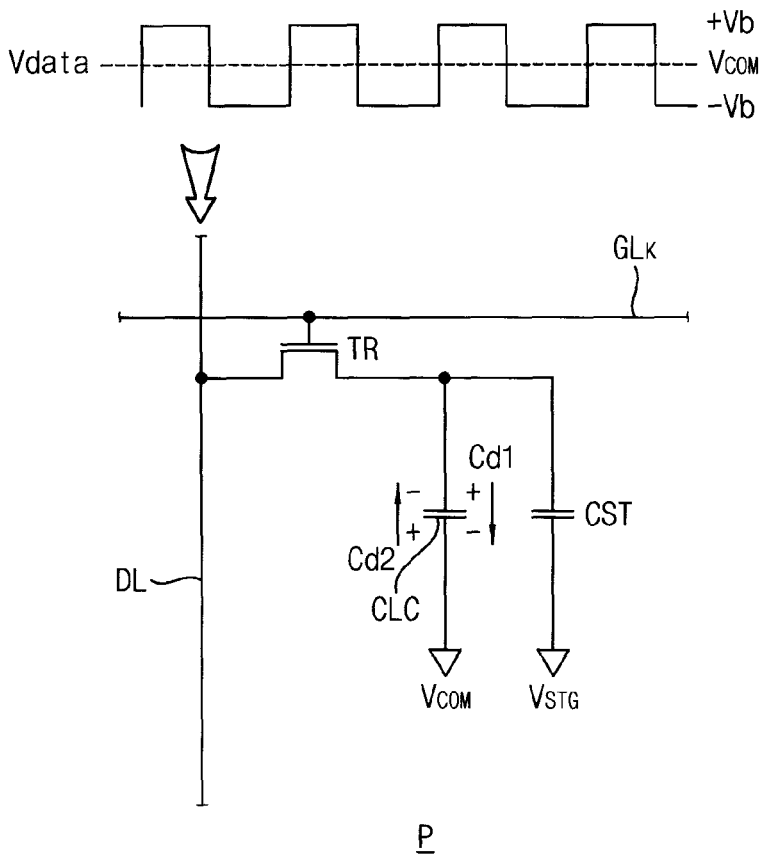
FIG. 3 is an equivalent circuit diagram and waveform illustrating a method of driving a pixel connected to a dummy line as shown in FIG. 2, according to an exemplary embodiment of the present invention.

FIG. 2 is a waveform diagram illustrating a method of driving a display panel as shown in FIG. 1, according to an exemplary embodiment of the present invention. FIG. 3 is an equivalent circuit diagram and waveform illustrating a method of driving a pixel connected to a dummy line as shown in FIG. 2, according to an exemplary embodiment of the present invention.

Referring to FIGS. 1, 2 and 3, the panel driving part 200 drives the display panel 100 by a frame period which includes the active period ACP and the vertical blanking period VBP. Hereinafter, an image displayed on the display panel 100 may be referred to as a white image.

The gate driving part 240 sequentially outputs the gate signals in response to the vertical starting signal STV. During the active period ACP, the gate driving part 240 sequentially outputs first to N-th gate signals G1, G2, . . . , GN having the first pulse width PW1 to the first to N-th gate lines GL1, . . . , GLN. Each of the first to N-th gate signals G1, G2, . . . , GN has a gate-on level ON during a corresponding horizontal period. During the vertical blanking period VBP, the gate driving part 240 outputs the K-th gate signal GK having the second pulse width PW2 to the K-th gate line GLK. The K-th gate signal GK is output after the N-th gate signal GN is output. The K-th gate signal GK is maintained at the gate-on level ON during the vertical blanking period VBP.

The data driving part 230 outputs the data voltage to the display panel 100 by the horizontal period (1H) in response to the data enable signal DE.

For example, the data voltage Vdata applied to a predetermined data line will be explained.

During the active period ACP, the data driving part 230 provides the data line with a white voltage +Vw which has a voltage level corresponding to a white gray-scale and the first polarity (+) corresponding to the high level of the polarity control signal POL.

Then, during the vertical blanking period VBP, the data driving part 230 provides the data line with black voltages +Vb and −Vb which have voltage levels corresponding to a black gray-scale, and the first and the second polarities polarity (+) and (−) corresponding to the polarity control signal POL swinging between the high level and the low.

Referring to FIG. 3, during the vertical blanking period VBP, the K-th gate line GLK receives the gate signal GK having the gate-on level ON. The data line DL repetitively receives the black voltage +Vb of the first polarity (+) and the black voltage −Vb of the second polarity (−). Therefore, the LC capacitor CLC in the pixel P connected to the K-th gate line GLK repetitively receives the black voltage +Vb of the first polarity (+) and the black voltage −Vb of the second polarity (−).

During a first period during in which the black voltage +Vb of the first polarity (+) is applied to the data line DL, the black voltage +Vb is applied to a first end portion of the LC capacitor CLC and the reference voltage VCOM is applied to a second end portion of the LC capacitor CLC. Thus, the LC capacitor CLC charges an electric charge corresponding to the black gray-scale in a first charge direction cd1.

However, during a second period in which the black voltage −Vb of the second polarity (−) is applied to the data line DL, the black voltage −Vb is applied to the first end portion of the LC capacitor CLC and the reference voltage VCOM is applied to the second end portion of the LC capacitor CLC. Thus, the LC capacitor CLC charges an electric charge corresponding to the black gray-scale in a second charge direction cd2. The second charge direction cd2 is opposite to the first charge direction cd1.

As described above, during the vertical blanking period VBP, the LC capacitor CLC repetitively receives the data voltage Vdata swinging between the first polarity (+) and the second polarity (−) so that the load of the display panel 100 may be increased. A swing period of the data voltage Vdata swinging between the first polarity (+) and the second polarity (−) may be preset based on the electric power consumption and the voltage regulation of the analog supply voltage AVDD.

Therefore, during the vertical blanking period VBP, the load of the output end portion of the driving voltage generating part 220 may be increased so that the output current of the output end portion may be prevented from being increased. Thus, the voltage regulation of the output end portion may be decreased so that the driving reliability of the driving voltage generating part 220 may be improved. In addition, an audible noise which is generated by a vibration of a metal plate in the LC capacitor CLC may be removed.

Figure 4:
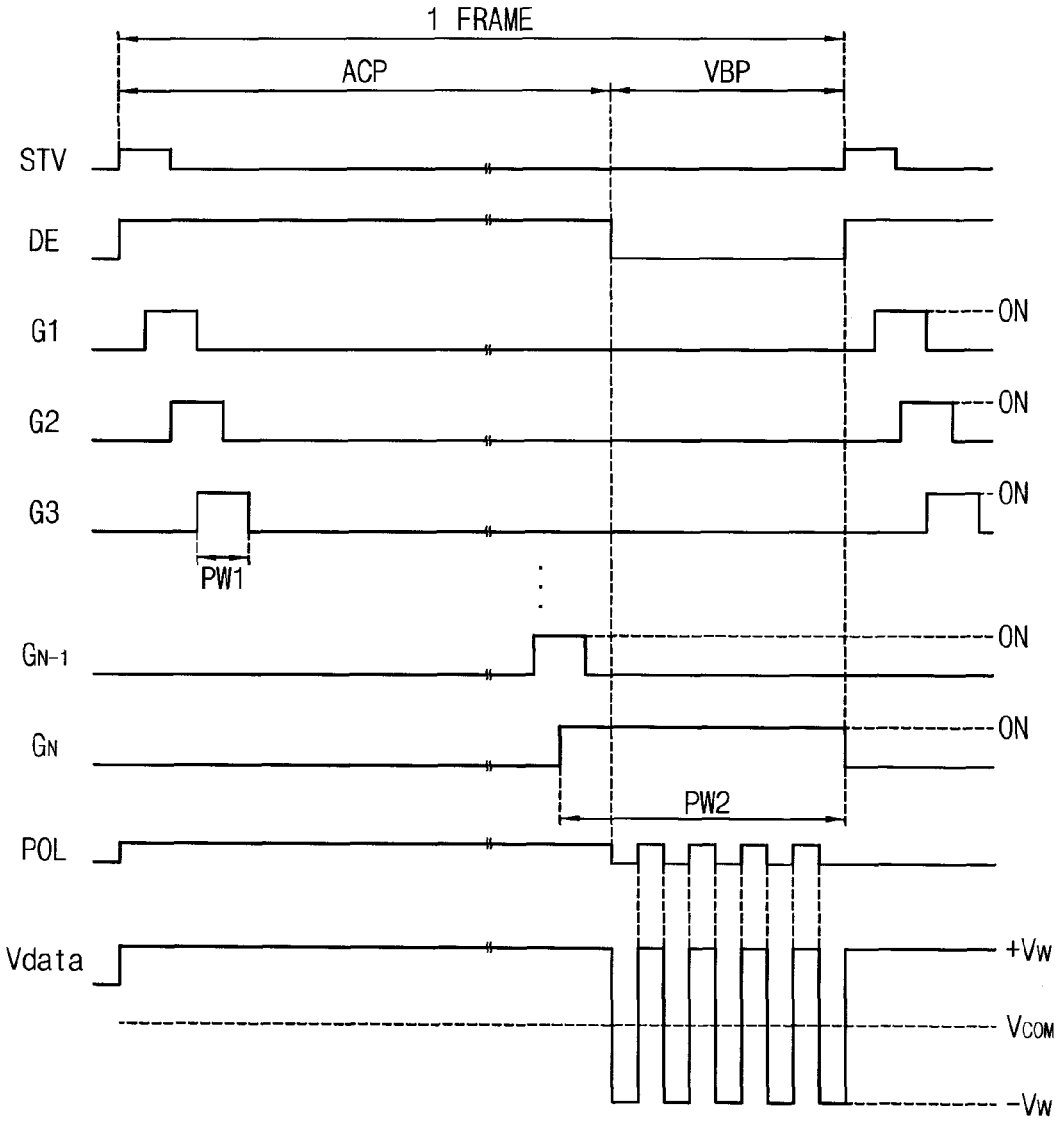
FIG. 4 is a waveform diagram illustrating a method of driving a display panel according to an exemplary embodiment of the present invention.

FIG. 4 is a waveform diagram illustrating a method of driving a display panel according to an exemplary embodiment of the present invention.

The waveform diagram in FIG. 4 is for a display panel like that shown in FIG. 1, except that the display panel of the present exemplary embodiment omits the K-th gate line GLK, in other words, the dummy line from the display panel 100 of FIG. 1.

The panel driving part 200 is driven by a frame period 1FRAME which includes an active period ACP and a vertical blanking period VBP. Hereinafter, an image displayed on the display panel 100 may be referred to as a white image.

The gate driving part 240 sequentially outputs the gate signals in response to the vertical starting signal STV. During the active period ACP, the gate driving part 240 sequentially provides the first to (N−1)-th gate lines GL1, . . . , GLN−1 with first to (N−1)-th gate signals G1, . . . , G2, . . . , GN−1 having the first pulse width PW1. Each of the first to (N−1)-th gate signals G1, G2, . . . , GN−1 has a gate-on level ON during a corresponding horizontal period (1H).

During the vertical blanking period VBP, the gate driving part 240 outputs an N-th gate signal GN to a last gate line GLN. The N-th gate signal GN has a second pulse width PW2 during the vertical blanking period VBP. According to an exemplary embodiment of the present invention, the N-th gate signal GN is maintained at the gate-on level ON during a latter period of the active period ACP and an entire period of the vertical blanking period VBP.

The data driving part 230 outputs the data voltage to the display panel 100 by the horizontal period (1H) in response to the data enable signal DE.

For example, the data voltage Vdata applied to a predetermined data line will be explained.

During the active period ACP, the data driving part 230 provides the data line with a white voltage +Vw which has a voltage level corresponding to a white gray-scale and the first polarity (+) corresponding to the high level of the polarity control signal POL.

Then, during the vertical blanking period VBP, the data driving part 230 provides the data line with a data voltage which is the same as a data voltage applied to the pixels connected to the N-th gate line GLN.

For example, as shown in FIG. 4, during the vertical blanking period VBP, the data driving part 230 provides the data line with a white voltage which is the same as a white voltage applied to the pixels connected to the N-th gate line GLN. In other words, the data driving part 230 provides the data line with the white voltages +Vw and −Vw which have the first polarity (+) and the second polarity (−) corresponding to the polarity control signal POL swinging between the high level and the low level.

As described above, during the vertical blanking period VBP, the LC capacitor CLC repetitively receives the data voltage Vdata swinging between the first polarity (+) and the second polarity (−) so that the load of the display panel 100 may be increased. Thus, the voltage regulation of the output end portion of the driving voltage generating part 220 may be decreased so that the driving reliability of the driving voltage generating part 220 may be improved. In addition, an audible noise which is generated by a vibration of a metal plate in the LC capacitor CLC may be removed.

While the present invention has been particularly shown and described with reference to exemplary embodiments thereof, it will be understood by those of ordinary skill in the art that various changes in form and detail may be made therein without departing from the spirit and scope of the present invention as defined by the following claims.

What is claimed is:

1. A method of driving a display panel, comprising:

providing at least one gate line among a plurality of gate lines disposed in the display panel with a gate signal of a gate-on level during a vertical blanking period of a frame period; and providing a data line disposed in the display panel with data voltages of a first polarity and a second polarity opposite to the first polarity during the vertical blanking period, wherein the gate signal of the gate-on level is applied to a last gate line among the plurality of gate lines during the vertical blanking period, wherein the gate signal of the gate-on level applied to the last gate line has a pulse width greater than a pulse width of a gate signal previously applied to another gate.

2. The method of claim 1, wherein the data voltages of the first and second polarities correspond to a black gray-scale.

3. The method of claim 1, wherein the data voltages of the first and second polarities correspond to a gray-scale of a pixel connected to the last gate line.

4. The method of claim 1, further comprising:

generating a polarity control signal for controlling the polarity of the data voltages, wherein the polarity control signal swings between a high level and a low level during the vertical blanking period.

5. A display apparatus, comprising:

a display panel comprising a plurality of gate lines and a plurality of data lines;

a gate driving part configured to provide at least one gate line among the plurality of gate lines with a gate signal of a gate-on level during a vertical blanking period of a frame period; and a data driving part configured to provide a data line of the plurality of data lines with data voltages of a first polarity and a second polarity opposite to the first polarity during the vertical blanking period, wherein the gate driving part provides a last gate line among the plurality of gate lines with the gate signal of the gate-on level during the vertical blanking period, wherein the gate signal of the gate-on level applied to the last gate line has a pulse width greater than a pulse width of a gate signal previously applied to another gate line.

6. The display apparatus of claim 5, wherein the display panel comprises a display area configured to display an image and a blocking area surrounding the display area and configured to block light, and a pixel connected to the last gate line among the plurality of gate lines is disposed in the blocking area.

7. The display apparatus of claim 6, wherein the data voltages of the first and second polarities correspond to a black gray-scale.

8. The display apparatus of claim 5, wherein the display panel comprises a display area configured to display an image and a blocking area surrounding the display area and configured to block light, and a pixel connected to the last gate line among the plurality of gate lines is disposed in the display area.

9. The display apparatus of claim 8, wherein the data voltages of the first and second polarities correspond to a grayscale of a pixel connected to the last gate line.

10. The display apparatus of claim 5, further comprising:

a timing control part configured to generate a polarity control signal for controlling the polarity of the data voltages, wherein the polarity control signal swings between a high level and a low level during the vertical blanking period.

11. The display apparatus of claim 10, wherein the polarity control signal swings between the high level and the low level during an active period of the frame period.

12. The display apparatus of claim 10, Wherein the polarity control signal is maintained at the high level or the low level during an active period of the frame period.

13. A method of driving a display panel, comprising:

activating a gate line of the display panel during a vertical blanking period; and applying a data voltage to a data line of the display panel during the vertical blanking period, wherein the data voltage is repeatedly alternated between different voltage levels during the vertical blanking period.

14. The method of claim 13, wherein the gate line is a dummy line of the display panel.

15. The method of claim 13, wherein the gate line is a last horizontal gate line of the display panel.

16. The method of claim 13, wherein the different voltage levels correspond to black voltages or white voltages.

* * * * *